US006565059B1

(12) United States Patent
Falconer

(10) Patent No.: US 6,565,059 B1
(45) Date of Patent: May 20, 2003

(54) HAND REST FOR AN ARTIST'S EASEL

(76) Inventor: Leonard S. Falconer, 8 Costero Aisle, Irvine, CA (US) 92614

( * ) Notice: Subject to any disclaimer, the term of this patent is extended or adjusted under 35 U.S.C. 154(b) by 0 days.

(21) Appl. No.: 10/119,741

(22) Filed: Apr. 9, 2002

(51) Int. Cl.[7] ..... A47B 19/00
(52) U.S. Cl. ..... 248/441.1; 248/118.3
(58) Field of Search ..... 248/118, 118.1, 248/118.3, 118.5, 441.1

(56) References Cited

U.S. PATENT DOCUMENTS 3,815,856 A * 6/1974 Cortimilia ..... 248/118
3,972,133 A * 8/1976 Parshall ..... 248/118
4,685,644 A * 8/1987 Yates ..... 248/118.3
5,141,198 A * 8/1992 Hoyt ..... 248/441.1
5,172,883 A * 12/1992 Amirian ..... 248/118

* cited by examiner

*Primary Examiner*—Ramon O. Ramirez

(57) ABSTRACT

Hand rests are desirable to the artist for steadying the hand when performing delicate brush strokes. The use of this invention provides added control to both the oil and water color artist. The hand rest is a welcome addition to the recreational artist because it can help him complete more difficult brush strokes with a steadier hand. Additionally, the hand rest is lightweight and easy to install on either an easel or canvas, making it readily portable. The hand rest for an artist's easel consists of a peg assembly and a hand rest. The peg assembly consists of a lightweight aluminum rod with pegs incorporated along its length and is positioned vertically on the left or right side of the easel depending upon which hand the artist uses to paint. The hand rest consists of a cylindrical birch wood rod with end caps, one end of which is positioned upon one of the pegs and the other end of which is supported by the artist's free hand. Positioning is easily changed by moving the hand rest rod to another peg.

10 Claims, 2 Drawing Sheets

HAND REST FOR AN ARTIST'S EASEL

BACKGROUND OF THE INVENTION

1. Field of the Invention

The present invention relates to a hand rest for use in connection with an artist's easel. The hand rest has particular utility in connection with helping the artist to steady his hand when painting.

2. Description of the Prior Art

Hand rests are desirable to the artist for steadying the hand when performing delicate brush strokes. The use of this invention provides added control to both the oil and water-color artist. The hand rest is a welcome addition to the recreational artist because it can help him complete more difficult brush strokes with a steadier hand. Additionally, the hand rest is lightweight and easy to install, making it readily portable.

The use of hand rests is known in the prior art. One conventional device, which is widely known in the art, is a maulstick; however, there are problems inherent in its use. The major problem is that one end of the maul stick rests on the media which may damage the artwork, especially for oils which have extended drying times. Since substantial effort and skill are required for an artist to hold the rubber-tipped end of the maulstick firmly against the work surface with one hand at the same time painting or drawing with the other hand while it rests on the stick, amateur artists and those without strong hands would not benefit from using this device.

Other types of hand rest devices are also known in the art. For example, U.S. Pat. No. 5,141,198 to Marion E. Hoyt discloses an apparatus for steadying one's arm at an easel and use thereof. However, the Hoyt '198 patent provides only a single point of origin for the arc of the hand rest member such that the hand rest member is at an uncomfortable angle for some portions of the canvas, and has the further drawback of not providing a means of ensuring that some part of the hand rest member will not drag against the artist's work if accidentally dropped.

U.S. Pat. No. 3,815,856 to Angelo J. Cortimilia discloses a hand rest attachment for artist's easel that enables the artist to rest and steady his hand. However, the Cortimilia '856 patent applies only to floor easels and makes no provision for tabletop easels. Additionally, since the Cortimilia '856 device is affixed to the easel with several fasteners, it is not easily attached or detached from the easel for multiple uses on the same piece of work. Thereby, the artist would be forced to either paint with the device interfering with his workspace or take several minutes to attach and detach the device with each use.

Similarly, U.S. Pat. No. 5,765,791 to Raymond R. Givonetti discloses a hand rest for an easel that provides a palm rest within which the artist's hand rests. However, the Givonetti '791 patent does not provide for free movement of the hand along the support member, and the device must be remounted if the arc defined by the initial placement does not cover the area within which the artist desires to work.

Likewise, U.S. Pat. No. 5,299,772 to Michael S. Weber discloses multifunctional tools for artists that provide a hand bridge upon which the hand can be rested. The Weber '772 patent is similar to the previously described maulstick device, with a hand bridge pivotally mounted on the frame of a canvas. However, the Weber '772 device allows only three positions in which the hand bridge may reside, and has the further drawback of supporting the distal end of the hand bridge against the canvas.

U.S. Pat. No. 5,172,883 to Acop J. Amirian discloses an artist's tool which enables the artist to rest his hand while painting a canvas. The Amirian '883 device has a horizontal support that can be vertically adjusted and a vertical support which can be horizontally adjusted. However, the Amirian '883 device is designed such that it can be used on only one type and or size of easel. This device can not easily be removed from the easel and placed on another easel of a different size and construction.

Lastly, U.S. Pat. No. Des. 376,618 to Tommy N. Hix discloses an ornamental design for a hand rest, presumably to be used in conjunction with an artist's easel. However, the Hix '618 patent does not provide any means of attachment to an easel, and has the additional deficiency of only allowing motion in a horizontal plane.

While the above-described devices fulfill their respective, particular objectives and requirements, the aforementioned patents do not describe a hand rest for an artist's easel that allows easy attachment to and detachment from any type of easel for both right and left-handed artists and provides multitudinous angles and positions from which to paint. The Hoyt '198 patent makes no provision for protecting the artist's work if the end of the device is accidentally dropped and also requires the artist to work from an uncomfortable angle for some portions of the canvas since the hand rest is fixed at one end. The Cortimilia '856 patent applies to only floor type easels and requires the artist to adjust several fasteners for attachment and detachment, rendering it difficult to remove during the artist's work session. The Givonetti '791 patent does not provide for free movement of the hand along the support member, and the device must be remounted if the arc defined by the initial placement does not cover the area within which the artist desires to work. The Weber '772 patent allows only three positions in which the hand bridge may reside, and has the further drawback of supporting the distal end of the hand bridge against the canvas. The Amirian '883 patent can only be used on one type and or size of easel and can not easily be removed from the easel and placed on another easel of a different size and construction. Finally, the Hix '618 patent does not provide any means of attachment to an easel, and has the additional deficiency of only allowing motion in a horizontal plane.

Therefore, a need exists for a new and improved hand rest for an artist's easel that can be used for supporting the artist's hand while painting. In this regard, the present invention substantially fulfills this need. In this respect, the hand rest for an artist's easel according to the present invention substantially departs from the conventional concepts and designs of the prior art, and in doing so provides an apparatus primarily developed for the purpose of supporting an artist's hand while painting.

SUMMARY OF THE INVENTION

In view of the foregoing disadvantages inherent in the known types of hand rest for an artist's easel now present in the prior art, the present invention provides an improved hand rest for an artist's easel, and overcomes the above-mentioned disadvantages and drawbacks of the prior art. As such, the general purpose of the present invention, which will be described subsequently in greater detail, is to provide a new and improved hand rest for an artist's easel which has all the advantages of the prior art mentioned heretofore and many novel features that result in a hand rest for an artist's easel which is not anticipated, rendered obvious, suggested, or even implied by the prior art, either alone or in any combination thereof.

To attain this, the present invention essentially comprises a hand rest for mounting on a canvas or easel which consists of a first adjustable vertical member having a series of uniquely shaped pegs extending therefrom for engaging an easel in a plurality of orientations, such that a supplemental rod further removably couples to the peg-like members for presenting a horizontally adjustable arm resting element.

There has thus been outlined, rather broadly, the more important features of the invention in order that the detailed description thereof that follows may be better understood and in order that the present contribution to the art may be better appreciated.

The invention may also include a means for mounting the hand rest for an artist's easel on a canvas or easel. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand rest for an artist's easel that has all of the advantages of the prior art hand rest for an artist's easel and none of the disadvantages.

It is another object of the present invention to provide a new and improved hand rest for an artist's easel that may be easily and efficiently manufactured and marketed.

An even further object of the present invention is to provide a new and improved hand rest for an artist's easel that has a low cost of manufacture with regard to both materials and labor, and which accordingly is then susceptible of low prices of sale to the consuming public, thereby making such a hand rest for an artist's easel economically available to the buying public.

Still another object of the present invention is to provide a new hand rest for an artist's easel that provides in the apparatuses and methods of the prior art some of the advantages thereof, while simultaneously overcoming some of the disadvantages normally associated therewith.

Even still another object of the present invention is to provide a hand rest for an artist's easel for providing support to the artist's hands during painting. This allows the artist a greater amount of control while completing delicate brush strokes, leading to a more attractive work of art.

Lastly, it is an object of the present invention to provide a new and improved hand rest for an artist's easel that is lightweight and can easily and quickly be secured to the easel or canvas.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
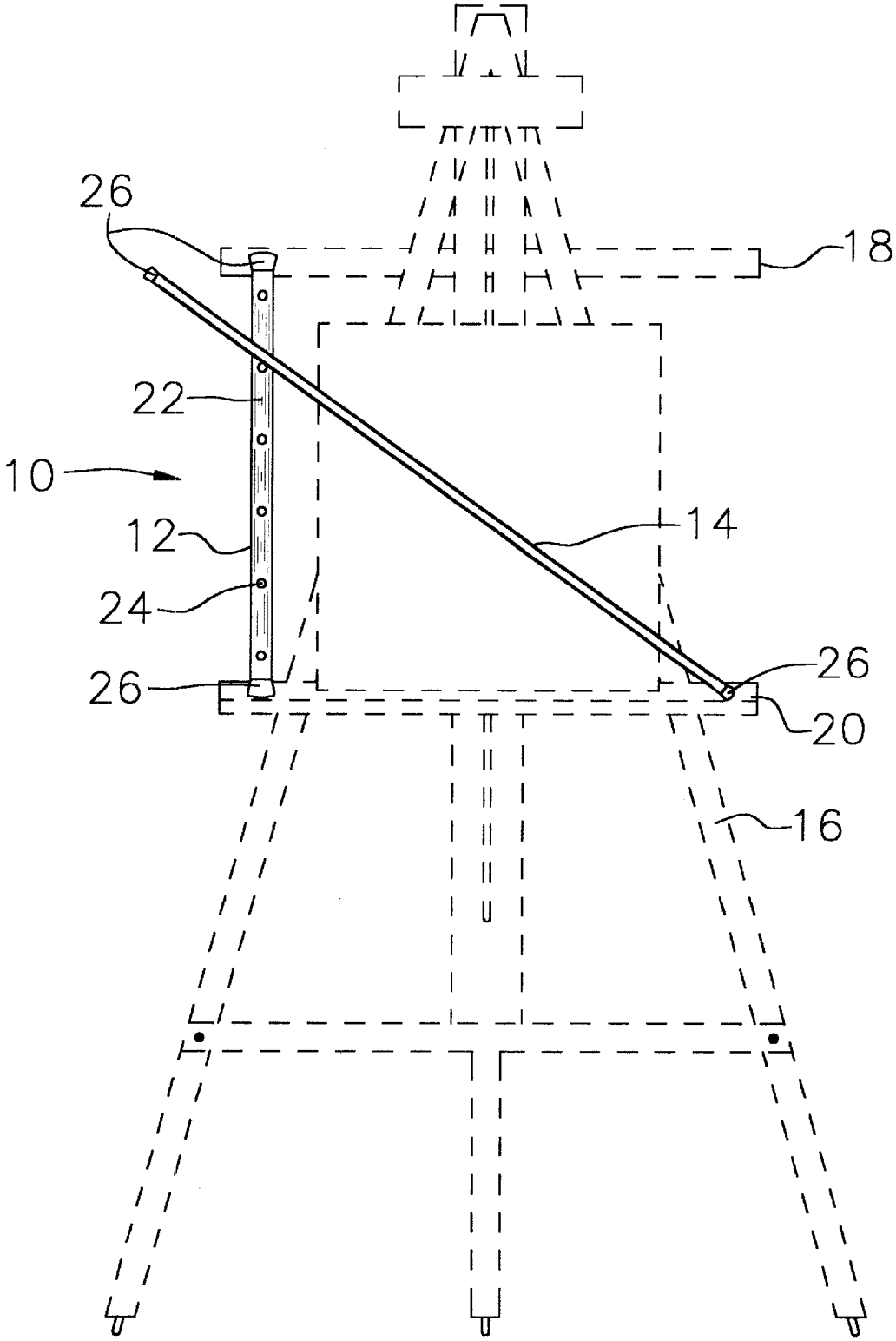
FIG. 1 is a front side view of the preferred embodiment of the hand rest for an artist's easel constructed in accordance with the principles of the present invention.
Figure 2:
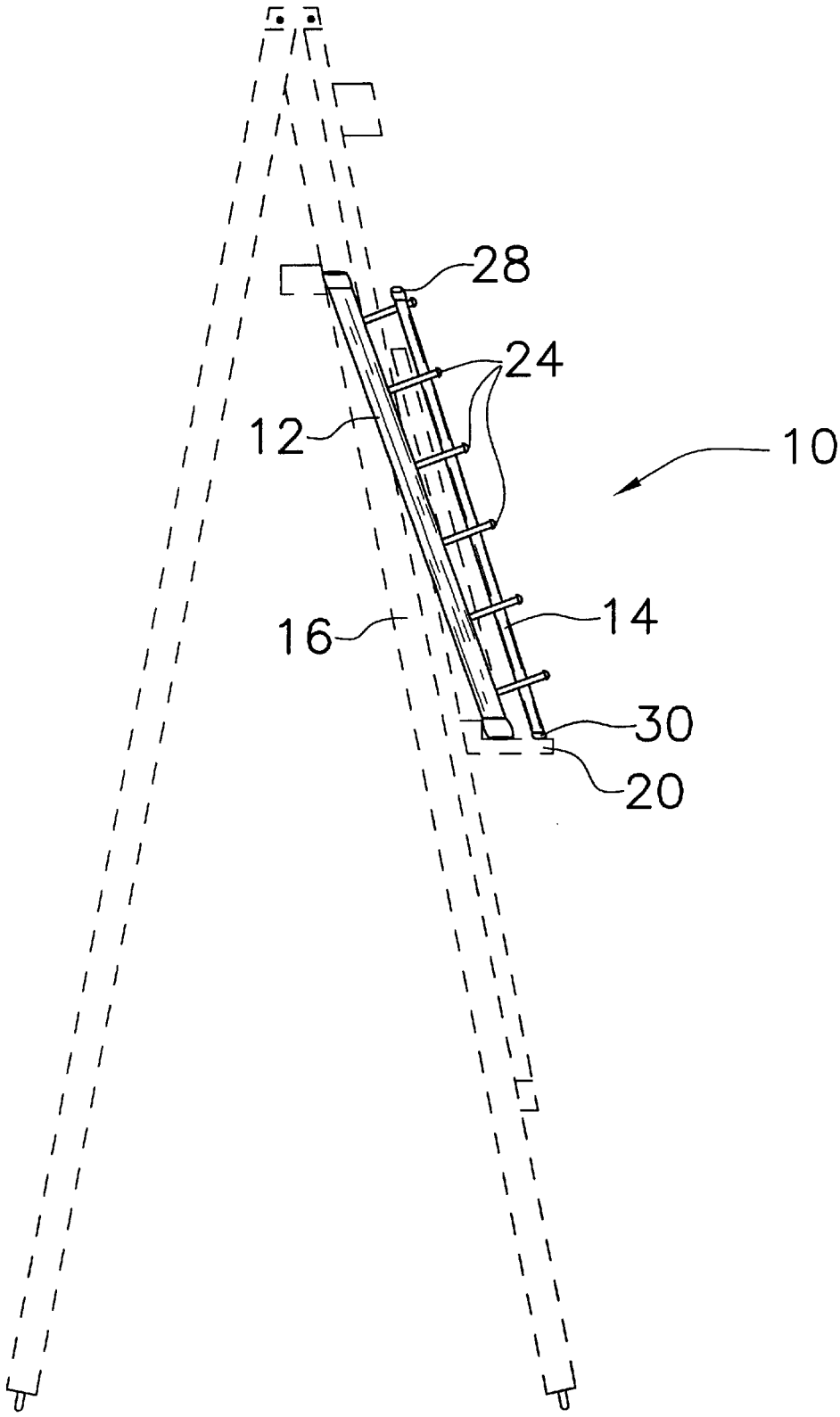
FIG. 2 is a left side view of the hand rest for an artist's easel of the present invention. The same reference numerals refer to the same parts throughout the various figures.

Referring now to the drawings, and particularly to FIGS. 1 and 2, a preferred embodiment of the hand rest for an artist's easel of the present invention is shown and generally designated by the reference numeral 10.

In FIG. 1, a new and improved hand rest for an artist's easel 10 of the present invention for supporting an artist's hand during painting or sketching is illustrated and will be described. More particularly, the hand rest for an artist's easel 10 consists of a peg assembly 12 and a hand rest 14. The peg assembly 12 is positioned vertically on the left side of the easel 16 and is supported by the upper and lower horizontal easel members 18 and 20, respectively. The peg assembly 12 is mounted for a left-handed painter and could be moved to the right side of the easel for a right-handed painter. The peg assembly 12 consists of a lightweight aluminum rod 22 measuring approximately 36 inches in length and of sufficient radius to ensure that the hand rest 14 will not come into contact with the artist's work. Incorporated throughout the length of the rod 22 are pegs 24 measuring approximately 1 inch in height. At each end of the rod 22 are rubber end caps 26. The hand rest 14, which also measures approximately 36 inches in length, is a cylindrical birch wood rod. At each end of the hand rest 14 are rubber end caps 26.

FIG. 2 shows a left side view of the implementation of the hand rest for an artist's easel 10. Again, this view shows the peg assembly 12 positioned to the left of the easel 16 as a left-handed artist would employ the invention; however, the peg assembly 12 could just as easily be moved to the right side of the easel 16 for a right-handed artist. The upper end 28 of the hand rest 14 is inserted between two pegs 24 for support at that end and the lower end 30 is shown resting on the lower horizontal easel member 20. In use, the artist would position and hold the lower end 30 of the hand rest 14 to provide support.

In use, it can now be understood that after placing the canvas on the easel 16, the artist installs the peg assembly 12 on the appropriate side of the easel by placing it between the upper and lower horizontal easel members 18 and. 20, respectively. The artist then places the upper end 28 of the hand rest 14 between two pegs 24 and the lower end 30 in the desired position. After determining ideal placement of the hand rest 14, the artist proceeds to rest one hand on the hand rest 14 while supporting the lower end 30 of the hand rest 14 with the other hand. In this way, the hand rest 14 can be adjusted minute amounts to produce the desired positioning while painting.

While a preferred embodiment of the hand rest for an artist's easel has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, cardboard, or a variety of wood may be used instead of the aluminum peg assembly described. Also, the birch wood rod may be made of heavy-duty plastic, wood, metal, or similar material. And although use with an artist's easel has been described, it should be appreciated that the hand rest herein described is also suitable for any other apparatus, such as a chalkboard, a whiteboard, or a quilting loom, which might be used wherein the user would need to rest his hands.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand rest for an artist's easel comprising:

a vertical support having a top, a central portion with a front and a back, and a bottom and having a length wherein said top of said support reaches at least to an upper horizontal member of an artist's easel when said bottom of said support is rested on a lower horizontal member of an artist's easel and formed with a plurality of pegs extending perpendicularly from said front of said central portion wherein each said peg extends from said front of said central portion in a direction parallel to each said other peg and said pegs are arranged along a line which is parallel to a longitudinal axis of said front surface of said central portion;

a first end cap connected to said top of said support;

a second end cap connected to said bottom of said support; and a rod having a first end and a second end and having a length sufficient to reach diagonally from said upper horizontal member of an artist's easel to said lower horizontal member of an artist's easel and removably connected to said vertical support wherein said first end of said rod is placed between two of said pegs and said second end of said rod rests on said lower horizontal member of an artist's easel.

2. The hand rest for an artist's easel of claim 1 wherein said vertical support is cylindrical.

3. The hand rest for an artist's easel of claim 1 wherein said rod is cylindrical.

4. The hand rest for an artist's easel of claim 1 wherein each said peg is spaced equidistant from each adjacent said peg.

5. The hand rest for an artist's easel of claim 4 wherein a plurality of angles from which to engage said artist's easel result from placing said first end of said rod upon different said pegs and supporting said second end of said rod with an artist's free hand.

6. The hand rest for an artist's easel of claim 5 wherein said vertical support has a sufficient diameter to ensure that said rod will not contact a painting placed on said artist's easel when said rod is rotated and used as a hand rest.

7. The hand rest for an artist's easel of claim 1 wherein said vertical support is removably connected to an artist's easel by placing said bottom of said support in said lower horizontal member of said easel and resting said top of said support against said upper horizontal member.

8. The hand rest for an artist's easel of claim 1 wherein said vertical support is comprised of aluminum.

9. The hand rest of claim 1 wherein said rod is comprised of birch wood.

10. The hand rest of claim 1 wherein said first end cap and said second end are comprised of rubber.

* * * * *